United States Patent [19]

Marshall

[11] Patent Number: 4,613,078

[45] Date of Patent: Sep. 23, 1986

[54] QUICK REPLACEABLE NOZZLE ASSEMBLY

[75] Inventor: Robert C. Marshall, Tucker, Ga.

[73] Assignee: Nordson Corporation, Amherst, Ohio

[21] Appl. No.: 598,428

[22] Filed: Apr. 9, 1984

[51] Int. Cl.[4] ..... B05B 15/06

[52] U.S. Cl. ..... 239/390; 222/567; 239/583; 239/600

[58] Field of Search ..... 239/390, 397, 569, 600, 239/583; 222/567, 570, 606, 543, 545, 478; 425/DIG. 34, DIG. 109, 126.5; 264/157, 297.1

[56] References Cited

U.S. PATENT DOCUMENTS

| | | | |
|---|---|---|---|
| 191,000 | 5/1877 | Campbell | 222/570 |
| 410,192 | 9/1889 | Price . | |
| 800,613 | 9/1905 | Hayes | 222/567 |
| 1,099,769 | 6/1914 | Sheaffer . | |
| 1,839,699 | 1/1932 | Parkhurst | 264/157 |
| 2,274,562 | 2/1942 | Palmer | 222/545 |
| 3,191,809 | 6/1965 | Schultz et al. | 222/567 |
| 3,290,194 | 12/1966 | Gillemot . | |
| 3,633,828 | 1/1972 | Larson . | |
| 3,815,788 | 6/1974 | Reighard et al. . | |
| 3,831,857 | 8/1974 | Scott . | |
| 4,334,637 | 6/1982 | Baker et al. | 239/600 |
| 4,360,132 | 11/1982 | Vilagi et al. . | |
| 4,364,521 | 12/1982 | Stankowitz | 239/397 |

FOREIGN PATENT DOCUMENTS

| | | | |
|---|---|---|---|
| 52632 | 3/1984 | Japan | 264/157 |

*Primary Examiner*—Joseph F. Peters, Jr.
*Assistant Examiner*—Michael J. Forman
*Attorney, Agent, or Firm*—Wood, Herron & Evans

[57] ABSTRACT

A dispensing gun for dispensing heated liquids from a nozzle at the discharge end of the gun. The nozzle is secured onto the end of the gun by a retainer, which retainer has a transverse slot through which replacement nozzles may be inserted into and removed from the gun. Replacement nozzles are mounted on a rigid nozzle holder by means of which the replacement nozzle may be inserted into the transverse slot of the retainer so as to push an old nozzle from the retainer slot and simultaneously insert a new replacement nozzle into the slot.

19 Claims, 5 Drawing Figures

QUICK REPLACEABLE NOZZLE ASSEMBLY

This invention relates to a liquid dispensing gun and more particularly to a dispensing gun for dispensing heated thermoplastic materials of the so-called "hot melt" adhesive type.

Thermoplastic adhesives or so-called "hot melt" adhesives are commonly used for bonding numerous diverse materials. Primarily, however, hot melts are used for sealing packages where high speed setting time of the hot melt material may be used to advantage. Commonly, such hot melt materials are solid at room temperature and are melted and then pumped in a molten state to an applicator head or gun. Usually such materials melt at a temperature in excess of 250° F. and are pumped through and dispensed from the applicator or gun at this temperature.

One characteristic of hot melt adhesives is that they tend to char or burn and create a solid residue if overheated or if maintained in a molten state for a prolonged period of time. This char then causes applicator problems, primarily at the nozzle, because the char settles in and blocks the relatively small orifice of the nozzle. Once the nozzle is blocked or plugged by the solid char, the nozzle must be removed and either cleaned or replaced. This cleaning or replacement though is a time consuming and sometimes difficult job because the nozzle is maintained at or near the molten temperature of the adhesive in order to prevent the adhesive from solidifying in the nozzle. But, at this temperature, the nozzle is difficult to handle or replace. Commonly, the nozzle is secured onto the end of the gun by means of a threaded nut such as disclosed, for example, in Vilagi, et al U.S. Pat. No. 4,360,132. In order to replace the nozzle, the hot nozzle and nozzle securing nut must either be allowed to cool down before it is handled or it must be handled at a very hot temperature. In either event, replacement of the nozzle is a time consuming, slow process which results in excessive down-time of the dispenser. Additionally, there is always the danger or possibility that the operator changing the nozzle may come into contact with and be burnt by the hot end of the dispenser or by the molten adhesive contained in the nozzle.

It has therefore been an objective of this invention to provide a new nozzle assembly for a hot melt or hot liquid dispensing gun which facilitates removal and replacement of a nozzle on that gun.

Still another objective of this invention has been to provide a new nozzle assembly which facilitates removal and replacement of a nozzle of the assembly with a minimum down-time of the dispensing apparatus of which the nozzle assembly is a part and without any need for special tools to effect the replacement.

Yet another objective of this invention has been to provide an improved nozzle assembly wherein the nozzle may be removed and replaced with a minimum of exposure of the operator effecting the replacement to the possibility of contact with hot areas of the nozzle assembly and/or molten adhesive material contained in the nozzle.

The invention of this application which accomplishes these objectives comprises a nozzle assembly mounted on the end of a dispenser gun body, which nozzle assembly includes a nozzle retainer secured onto the end of the gun body by a threaded nut. This retainer has a transverse slot therethrough which is adapted to receive a rigid strip within which there is mounted a replacement nozzle. This strip is so configured that when the threaded nut is loosened on the gun body, the retainer is thereby loosened so that the strip may be inserted into the transverse slot of the retainer to push the old nozzle from the slot while inserting a new nozzle. The strip preferably has a stop surface thereon engageable with a portion of the gun so that upon insertion of the strip into the slot, the stop surface functions to locate or position the new nozzle relative to the gun body. In the preferred practice of the invention, the strip also has a weakened neck area associated therewith so that after placement of the new nozzle into the slot and positioning of the nozzle therein, the strip may be broken off at the weakened neck area so as to leave the nozzle and broken off section of the strip within the retainer. The slotted retainer may then be tightened relative to the gun body by tightening the nut so as to secure the retainer onto the gun body. Thereby the nozzle is clamped in sealed relationship with the end of the gun body.

The primary advantage of this invention is that it enables nozzles of dispensing guns to be very quickly and easily replaced on the end of liquid dispensers without the need for any special tools. Additionally, if this nozzle assembly is used on a dispenser for dispensing hot or molten liquid materials, this invention enables the nozzles of the gun to be replaced without any need to handle the nozzle or without any need for the operator making the replacement to come into contact with any hot surfaces of the gun or any hot or molten liquid contained within the nozzle or the gun.

Yet another advantage of this invention is the ease with which it facilitates nozzle replacement in applications wherein the nozzle is used to apply liquid materials or adhesives to long strips of substrate located closely adjacent the nozzle tip. In many such applications the substrate is located very close, as for example 1/16th of an inch, from the nozzle tip. When the conventional prior art nozzle is to be replaced or cleaned in such an application, the substrate must first be removed from beneath the nozzle tip in order to provide access for nozzle removal. But, if the substrate is a long strip or web of material, this removal of the strip from beneath the tip may be a very difficult and time consuming process. The invention of this application though, by inserting the nozzle from the side rather than the end of the gun, eliminates the need to remove the substrate from beneath the nozzle for nozzle replacement and thereby saves substantial time and effort in applications where removal of the substrate is difficult.

These and other objects and advantages of this invention will be more readily apparent from the following description of the drawings in which.

Figure 1:
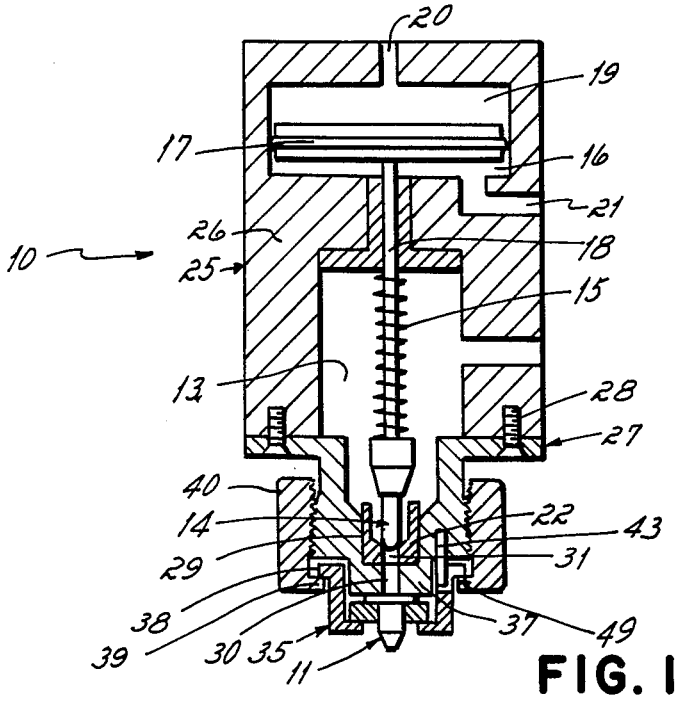
FIG. 1 is a partially diagrammatic illustration of a dispensing system for dispensing hot melt adhesive.
Figure 3:
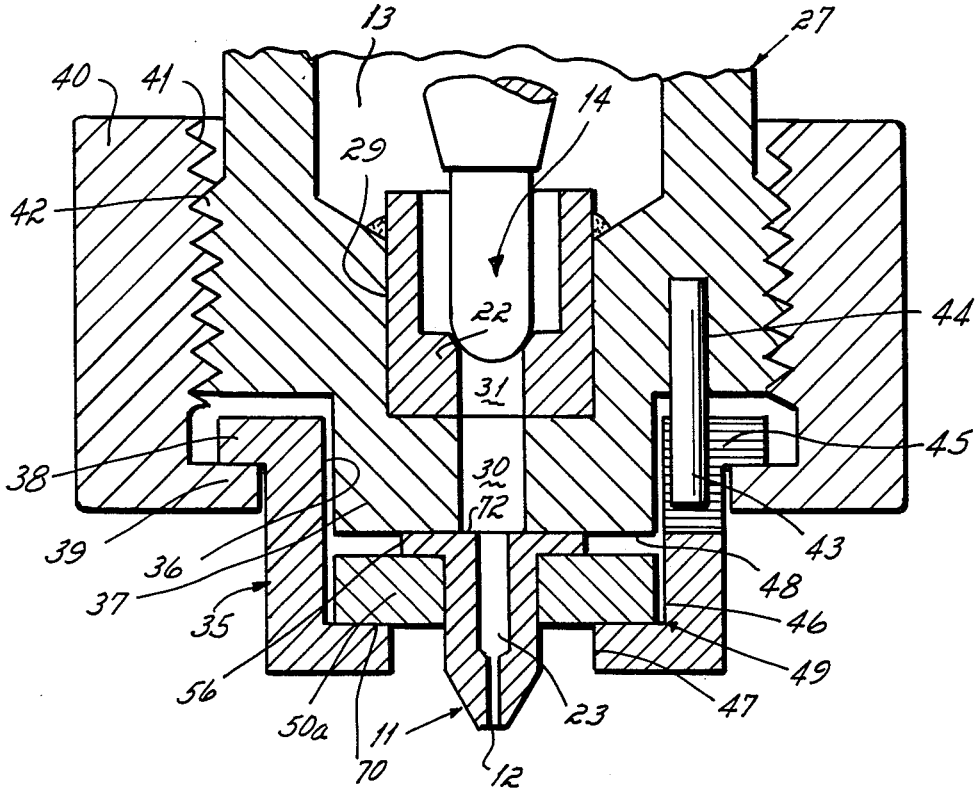
FIG. 3 is a cross sectional view taken on line 3—3 of FIG. 2.

Referring first to FIGS. 1 and 3, there is illustrated, partially diagrammatically, a dispensing gun 10 utilized in the practice of this invention. This gun 10 includes a nozzle 11 having an outlet orifice 12 through which molten adhesive material may be dispensed from a pressurized chamber 13 under the control of a flow control valve 14. This valve 14 is maintained in a closed position by a spring 15 and is opened as a consequence of air pressure being supplied to an air pressure chamber 16 of the gun. A piston 17 secured to the valve 14 by a rod 18 causes the valve to open and permit flow from the chamber 13 as a consequence of air pressure being supplied to the chamber 16. A chamber 19 on the opposite side of the piston 17 from the chamber 16 is open to atmosphere through an orifice 20.

In use, air at an appropriate pressure to overcome the spring 15 is supplied to the chamber 16 of the gun through a passage 21. This results in the piston moving upwardly and lifting the valve 14 off of a valve seat 22 contained internally of the gun 10. When this valve 14 opens, molten adhesive contained within the chamber 13 is free to flow from the chamber through an axial passage 23 contained in the nozzle and out through the orifice 12.

The body 25 of the gun 10 comprises a main body section 26 and a valve seat holder 27 mounted on the end of the main body section 26 by means of screws 28. The valve seat 22 is mounted within an axial bore 29 of the valve seat holder 27. The lower end of the valve seat holder is provided with a smaller diameter axial bore 30 which communicates with an axial bore 31 of the ball seat 22 and the axial passageway 23 of the nozzle 11.

Secured onto the lower end of the valve seat holder 27, there is a generally cylindrical nozzle strip retainer 35. This retainer has an axial bore 36 which fits over a reduced diameter end section 37 of the valve seat holder 27. At its upper end, this retainer 35 has an outwardly extending annular flange 38 engaged by an inwardly extending flange 39 of a nozzle retainer nut 40. The retainer nut has internal threads 41 threaded over external threads 42 of the valve seat holder 27.

To secure the nozzle strip retainer 35 against rotation relative to the valve seat holder 27, there is a roll pin 43 which extends between a bore 44 of the valve seat holder and a slot 45 of the nozzle strip retainer 35. The presence of this roll pin prevents the retainer 35 from rotating relative to the valve seat holder 27 while permitting the retainer 35 to move axially relative to the holder.

Figure 2:
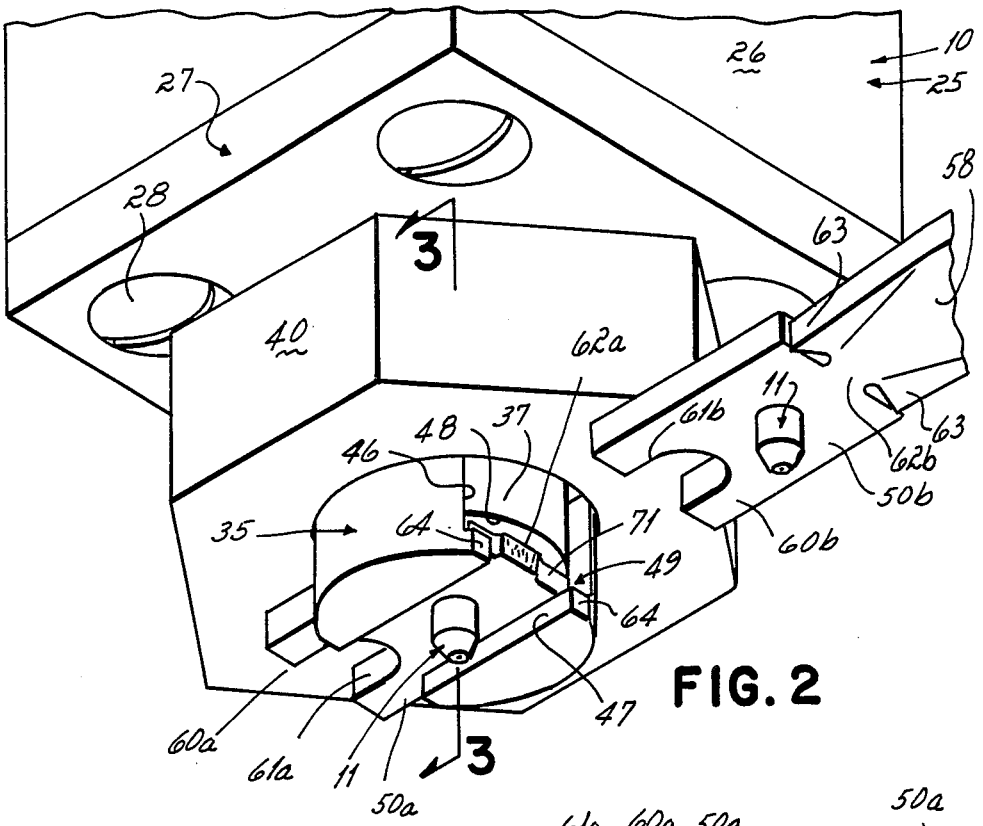
FIG. 2 is a perspective view of the nozzle end of the assembly of FIG. 1 illustrating the invention of this application.

With reference now particularly to FIG. 2, it will be seen that the nozzle strip retainer 35 has a pair of transverse slots 46, 47 machined therein. The uppermost slot 46 of these slots is wider than the lower slot 47 so that the two together define a generally T-shaped slideway 49. This slideway 49 extends transversely completely through the retainer 35 and is adapted to receive and support a nozzle holder strip 50, as explained more fully hereinafter.

Figure 4:
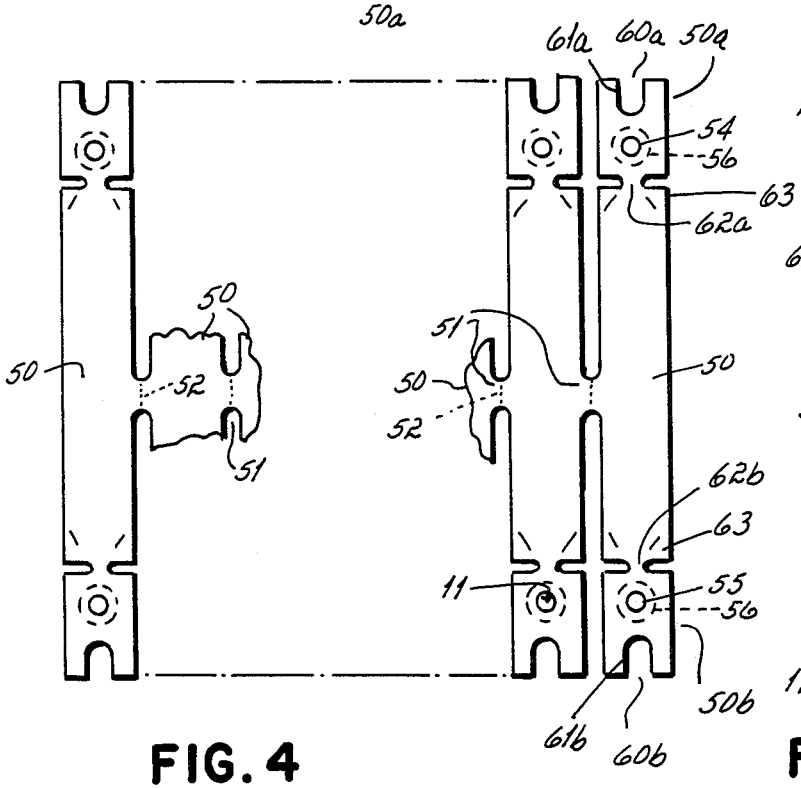
FIG. 4 is a top plan view of multiple connected nozzle strips utilized in the practice of this invention.

With reference to FIG. 4, there is illustrated a plurality of nozzle holder strips 50 interconnected by frangible neck sections 51. These frangible neck sections 51, when broken along the phantom lines 52, create a plurality of individual planar strips 50, each one of which carries a pair of nozzles 11. In a preferred embodiment, the strips 50 are all manufactured from aluminum and are adapted to receive the nozzles 11 within the bores 54, 55 which extend perpendicular to the generally planar surfaces 57, 58 of the strips. These bores are sized so as to receive the nozzles 11 in a press-fit relationship with a flange 56 on the end of the nozzle bearing against the planar surface 57 of the strip 50.

Each end **50*a*, 50*b* of the strip is bifurcated as indicated at 60*a* and 60*b* so as to define a pair of legs between which there is a slot 61*a*, 61*b*. Additionally, there is a necked end section 62*a*, 62*b* at each end of the strip 50 adjacent the nozzles 11. As explained more fully hereinafter, these necked end sections provide a frangible area of reduced width wherein the strips may be easily broken. The inner corners 63 located adjacent each of the necked sections 62*a*, 62*b* are bent out of the surface plane 58 of the strip 50 as may be most clearly seen in FIGS. 2 and 5. These corners 63 function as stops engageable with flats 64 of the nozzle retainer 35 to position a nozzle 11** within the retainer.

In use, nozzles may be easily replaced within the dispensing gun 10 by means of the nozzle holder strips 50 and the novel nozzle assembly structure of the gun 10. Specifically, nozzles are replaced by loosening the nozzle retainer nut 40 so as to move the nut toward the nozzle orifice or downwardly as viewed in FIGS. 2 and 3. This downward movement of the nut 40 releases the nozzle strip retainer 35 for similar downward movement relative to the gun body 25. During the course of moving downwardly or toward the nozzle orifice, the nozzle strip retainer is restrained against rotation by the roll pin 43. As a result of moving downwardly, the dimension of the transverse slideway 49 defined between the lower surface 48 of the gun body and the upper surface 70 of the retainer flange is increased thereby releasing the nozzle 11 and the nozzle containing section of the strip **50*a* for movement within the transverse slot 49. With the strip section 50*a* free for movement within the slot 49, the bifurcated end 60*b* of a strip 50*b* is moved into engagement with an end 71 of the strip 50*a* containing the nozzle 11, and located within the retainer 35. This bifurcated end of the strip 50*b* then is used to push the old nozzle 11 and end section 50*a* of retainer strip from the slot while simultaneously moving a new nozzle 11 and new nozzle containing end 50*b* of the strip 50 into the slot 49. The end 50*b* of the strip 50 may move inwardly while pushing the old strip 50*a* from the slot until the corner stops 63 of the strip 50 engage the stop surfaces 64 of the retainer 35. Thereby, the new nozzle 11 contained within the end section 50*b* of the strip 50 is positioned in axial alignment with the bore 30 of the gun body. With the new nozzle 11 and retainer strip 50*b* so positioned within the transverse slot 49 of the retainer, the nozzle retainer nut 40 is tightened so as to move the top surface 72 of the nozzle into sealed engagement with the bottom surface 48 of the gun body. Once the end 50*b* of the strip has been securely locked within the slot 49, the strip 50 is bent upwardly and downwardly until the frangible neck section 62*b* of the strip 50 breaks, thereby leaving the end section 50*b* separated from the remainder of the strip 50**.

Figure 5:
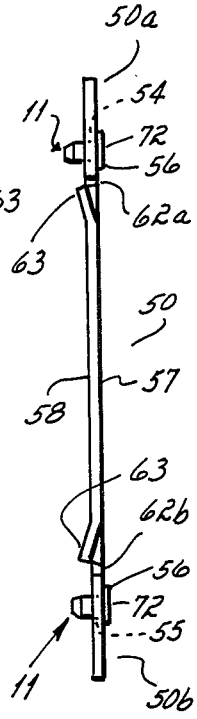
FIG. 5 is a side elevational view of a nozzle strip of FIG. 4.

As will be evident from the previous description and the illustrations of FIGS. 4 and 5, the next time that it becomes necessary to replace another nozzle, the bifurcated end of another strip 50 may be utilized to push an old nozzle from the slot 49 of the retainer and to simultaneously insert a new nozzle 11 within the retainer 35.

In the course of pushing an old nozzle 11 from the retainer 35 and inserting a new nozzle by means of the nozzle holder 50, it is possible to clear or flush the outlet passage 30 of the gun of any obstruction contained therein. To that end, slots **61*a* and 61*b* in the ends of the nozzle holder 50 are dimensioned so that after pushing an old nozzle 11 from the retainer 35, and before inserting a new nozzle, the slot 61***a* or 61*b* will be aligned with the passage 30. If the nozzle holder 50 is then stopped in this intermediate position, and if the valve 14 is then opened, liquid material and any obstructions contained therein may be flushed from the passage 30 through the slot 61*a* or 61*b*. Thereafter, the nozzle holder may be further pushed into the retainer 35 so as to align the new nozzle 11 with the passage 30. In this way obstructions may be easily cleared from the gun in the process of changing nozzles.

While I have described this invention as being applicable to a dispenser for hot melt adhesive, it will be appreciated that this invention is equally applicable to other types of dispensers. Specifically, it will be appreciated that it is particularly useful in dispensers of hot liquid material wherein the nozzle is maintained at a temperature at which it is difficult to handle without waiting a long period of time for the nozzle to cool down after its use is discontinued. Additionally, while I have described this invention as being applicable to an automatic gun wherein the valve is actuated by a pneumatic motor, persons skilled in the art will appreciate that the new nozzle assembly is equally applicable to manually actuated guns wherein the valve 14 is actuated by a manual trigger rather than a pneumatic motor. Furthermore, persons skilled in this art will appreciate that the invention does not require two nozzles 11 to be mounted within each strip, but that it is applicable to strips wherein only a single nozzle is mounted within a strip or wherein the strips are discontinuous rather than being formed as a part of multiple interconnected strips which are broken off from the other strips prior to insertion of a nozzle into the retainer of the dispensing gun.

These and other modifications and departures from the preferred embodiment of the invention illustrated herein will be appreciated by persons skilled in this art. Therefore, I do not intend to be limited except by the scope of the following amended claims:

I claim:

1. The combination of a dispensing gun for dispensing liquids and a nozzle holder strip for inserting a nozzle into said gun, said combination comprising, a gun body including a valve seat at one end thereof, a liquid flow passage within said one end of said gun body, said flow passage extending through said valve seat, a valve engageable with said valve seat, a nozzle retainer mounted for axial movement upon said gun body, said retainer having an axial bore extending therethrough, a transverse slot extending through at least one side of said retainer and intersecting said axial bore of said retainer, and a nozzle holder strip having a nozzle mounted thereon, said nozzle having an axial passage extending therethrough and terminating in a discharge orifice, and said strip being insertable into said transverse slot of said retainer so as to position said nozzle in said retainer with said nozzle passage in communication with said liquid flow passage of said gun body.

2. The combination of claim 1 which further includes means for moving said retainer on said gun body so as to clamp said nozzle in sealed engagement with said gun body.

3. The combination of claim 2 wherein said means for moving said retainer on said gun body comprises a nut threaded onto said gun body.

4. The combination of claim 1 which further includes means for moving said retainer axially on said gun body so as to clamp said nozzle in sealed engagement with said gun body while said nozzle remains mounted on said nozzle holder strip.

5. The combination of claim 1 wherein said nozzle holder strip comprises, a generally planar strip of rigid material having at least one bore extending therethrough, said bore being perpendicular to the plane of said strip, said nozzle being mounted within said bore, the axis of said nozzle passage being perpendicular to the plane of said strip, and locating means on said strip engageable with a locating surface of the nozzle retainer so as to position said nozzle relative to said gun body.

6. The combination of claim 5 wherein said nozzle holder strip has a weakened neck area, said weakened neck area of said strip being operable to facilitate breakage of said strip at said neck area after placement of said nozzle within said nozzle retainer of said dispensing gun.

7. The combination of claim 5 wherein said strip has two parallel bores therein and a nozzle mounted within each of said bores.

8. The combination of claim 7 wherein said strip has a pair of weakened neck areas, one of said weakened neck areas being located adjacent each of said bores, and said weakened neck areas being operable to facilitate breakage of said strip at said neck areas after placement of a nozzle within said nozzle retainer of said gun.

9. The combination of claim 7 wherein said strip has two locating means thereon, each of said locating means being engageable with a locating surface of the nozzle retainer so as to position one of said nozzles relative to said gun.

10. A dispensing gun for dispensing liquids, which gun comprises, a gun body including a valve seat at one end thereof, a liquid flow passage within said one end of said gun body, said flow passage extending through said valve seat, a valve engageable with said valve seat, a nozzle retainer retainer mounted for axial movement upon said valve seat, said retainer having an axial bore extending therethrough, a transverse slot extending through at least one side of said retainer and intersecting said axial bore of said retainer, a nozzle holder strip having a nozzle mounted thereon, said nozzle having an axial passage extending therethrough and terminating in a discharge orifice, and said strip being located within said transverse slot of said retainer with said nozzle positioned in said retainer so that said nozzle passage is aligned with said liquid flow passage of said gun body.

11. The dispensing gun of claim 10 which further includes means for moving said retainer axially on said gun body so as to clamp said nozzle in sealed engagement with said gun body.

12. The dispensing gun of claim 11, wherein said means for moving said retainer on said gun body comprises a nut threaded onto said gun body and having an inwardly extending flange engaged with said retainer.

13. The combination of a dispensing gun for dispensing liquids, and a nozzle holder strip for inserting a nozzle into said gun, said combination comprising, a gun body including a valve seat at one end thereof, a valve engageable with said valve seat, a liquid flow passage within said one end of said gun body, said flow passage extending through said valve seat, a nozzle retainer mounted for axial movement upon said gun body, said retainer having an axial bore extending therethrough, a transverse slot extending through opposite sides of said retainer and intersecting said axial bore ofsaid retainer, and a nozzle holder strip having a first nozzle mounted thereon, said first nozzle having an axial passage extending therethrough and terminating in a discharge orifice, and said strip being insertable into said transverse slot of said retainer so as to push a second nozzle from one side of said slot of said retainer while inserting said first nozzle mounted thereon into the opposite side of said retainer so as to position said first nozzle in said retainer with said passage of said first nozzle in communication with said liquid flow passage of said gun body.

14. The combination of claim 13 which further includes means for moving said retainer on said gun body so as to clamp said nozzle in sealed engagement with said gun body.

15. The combination of claim 14 wherein said means for moving said retainer on said gun body comprises a nut threaded onto said gun body.

16. The combination of claim 13 which further includes means for moving said retainer axially on said gun body so as to clamp said first nozzle in sealed engagement with said gun body while said first nozzle remains mounted on said nozzle holder strip.

17. A dispensing gun for dispensing liquids, which gun comprises, a gun body including a valve seat holder at one end thereof, a valve seat within said holder, a valve engageable with said valve seat, a liquid flow passage extending axially through said valve seat holder and through said valve seat, a nozzle retainer mounted for axial movement upon said valve seat holder, said retainer having an axial bore extending therethrough, a transverse slot extending through at least one side of said retainer and intersecting said axial bore of said retainer, and a nozzle holder strip having a nozzle mounted thereon, said nozzle having an axial passage extending therethrough and terminating in a discharge orifice, and said strip being located within said transverse slot of said retainer with said nozzle positioned in said retainer so that said nozzle passage is aligned with said liquid flow passage of said valve seat holder.

18. The dispensing gun of claim 17 which further includes means for moving said retainer axially on said valve seat holder so as to clamp said nozzle in sealed engagement with said valve seat holder.

19. The dispensing gun of claim 18 wherein said means for moving said retainer on said valve seat holder comprises a nut threaded onto said valve seat holder and having an inwardly extending flange engaged with said retainer.

* * * * *